United States Patent [19]

Deakyne

[11] Patent Number: 5,036,552

[45] Date of Patent: Aug. 6, 1991

[54] FASTENER

[76] Inventor: Ralph V. Deakyne, Millcroft Apt., 120, 255 Possum Park Rd., Newark, Del. 19711

[21] Appl. No.: 593,772

[22] Filed: Oct. 5, 1990

Related U.S. Application Data

[63] Continuation-in-part of Ser. No. 483,388, Feb. 22, 1990, Pat. No. 4,991,757.

[51] Int. Cl.[5] ..... A41F 3/00

[52] U.S. Cl. ..... 2/327; 24/68 CD; 24/519; 24/170; 2/326

[58] Field of Search ..... 2/326, 327; 24/495, 24/496, 498, 68 CD, 519, 170, 326, 327, 333, 350, 380, 336

[56] References Cited

U.S. PATENT DOCUMENTS

| | | | |
|---|---|---|---|
| 290,958 | 12/1883 | Atwood | 2/326 |
| 861,936 | 7/1907 | Batchelder | 2/326 |
| 1,398,288 | 11/1921 | Watkins | 24/507 |
| 3,204,636 | 9/1965 | Kariher et al. | 24/562 |
| 3,771,867 | 1/1973 | Mott | 2/326 |
| 4,991,757 | 2/1991 | Deakyne | 223/112 |

*Primary Examiner*—Werner H. Schroeder
*Assistant Examiner*—Gloria Hale
*Attorney, Agent, or Firm*—Connolly & Hutz

[57] ABSTRACT

A fastener includes a buckle in the form of a plate connected to a strap. A lower clamping jaw is mounted on the plate remote from the strap. A spring arm is mounted on the plate and has an upper clamping jaw. An actuating lever is disposed above the clamping jaws and extends beyond the spring arm. The lever is pivotally mounted to the plate so that movement of the free end of the lever toward and away from the spring arm causes the clamping jaws to selectively move toward and away from each other.

15 Claims, 3 Drawing Sheets

Fig. 8.
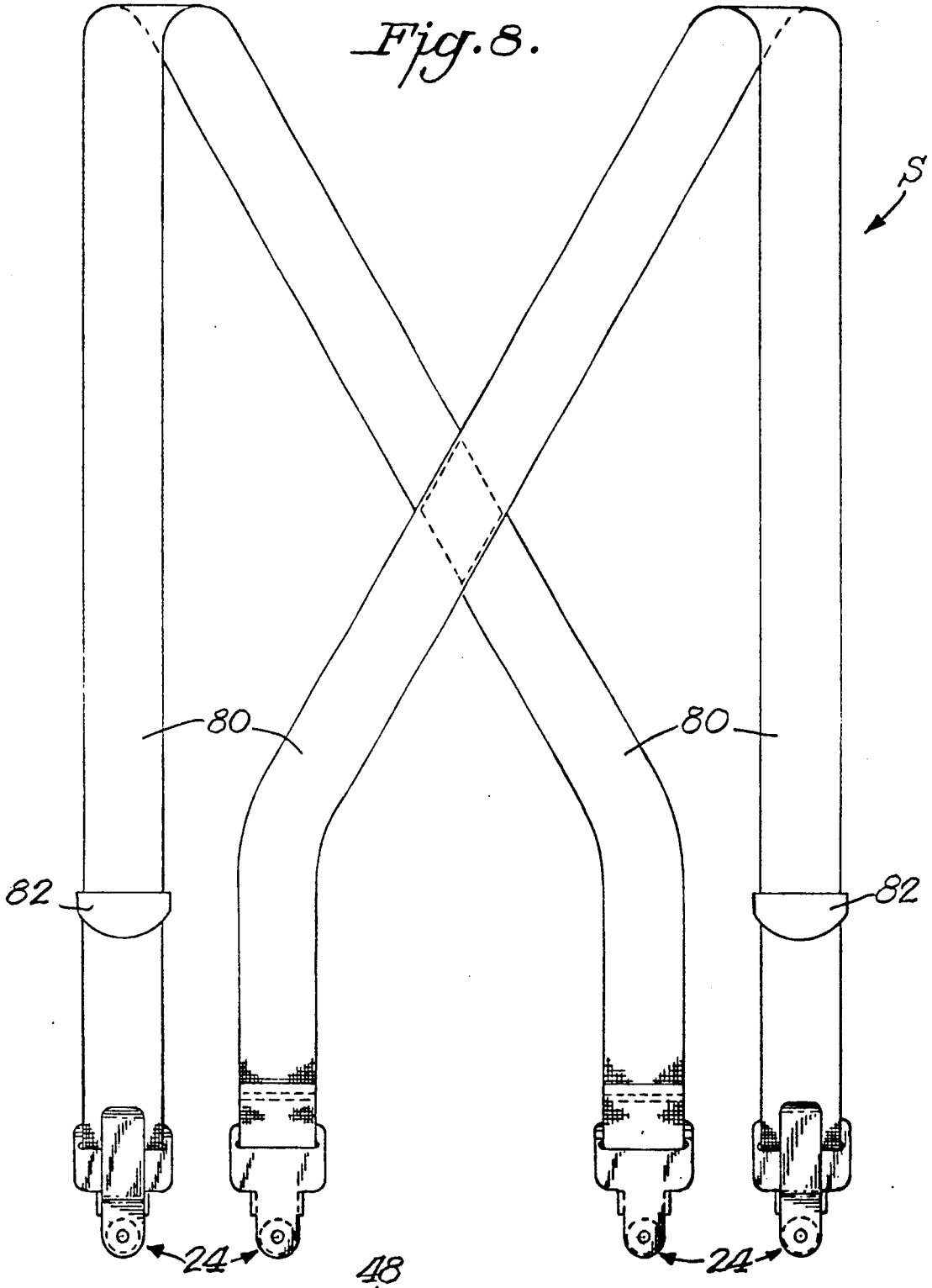
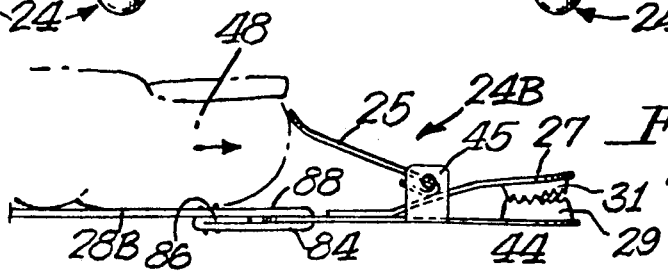
Fig. 9.

FASTENER

Cross-Reference to Related Application

This application is a continuation-in-part of co-pending application Ser. No. 483,388 filed Feb. 22, 1990, now U.S. Pat. NO. 4,991,757 issued 2-12-91.

BACKGROUND OF INVENTION

The present invention is concerned with the field of fasteners, particularly the type of fasteners which are used for textiles or articles of clothing. Such fasteners have common use, for example, as suspenders or other forms of buckles to attach an article of clothing. Various types of fasteners exist which work with varying degrees of effectiveness. It would be desirable if a fastener could be provided which could be conveniently operated with a single hand. Such fastener would have use, for example for clothing worn by a person having only one hand. Additionally, it would be desirable to provide fasteners which are not only effective in their holding ability, but also simple to manipulate so that, for example, the fasteners could be easily applied by elderly or disabled people.

SUMMARY OF INVENTION

An object of this invention is to provide a fastener which fulfills the above needs.

A further object of this invention is to provide such a fastener which can be easily and conveniently operated with a single hand.

A further object of this invention is to provide such a fastener which could be used for holding various article of clothing.

In accordance with this invention, the fastener is in the form of a buckle which includes a plate connected to a strap. A lower clamping jaw is fixed on the plate remote from the strap. A spring arm is provided with an upper clamping jaw which is movable toward and away from the lower clamping jaw so that an article of clothing could be clamped therebetween. An actuating lever is mounted to the plate and has a free end disposed above the spring arm so that it could control the movement of the spring arm and thereby effect a clamping or opening motion.

In a preferred embodiment of this invention the strap is secured to the plate by being inserted in a slot in the plate and then doubled over so that a three layered portion exists where the free end of the strap is secured to the remainder of the strap.

THE DRAWINGS

FIG. 8 is a front elevation view of a set of suspenders utilizing the fastener in accordance with this invention; and FIG. 9 is a side elevation view of a modified form of fastener in accordance with this invention.

DETAILED DESCRIPTION OF THE INVENTION

Figure 1:
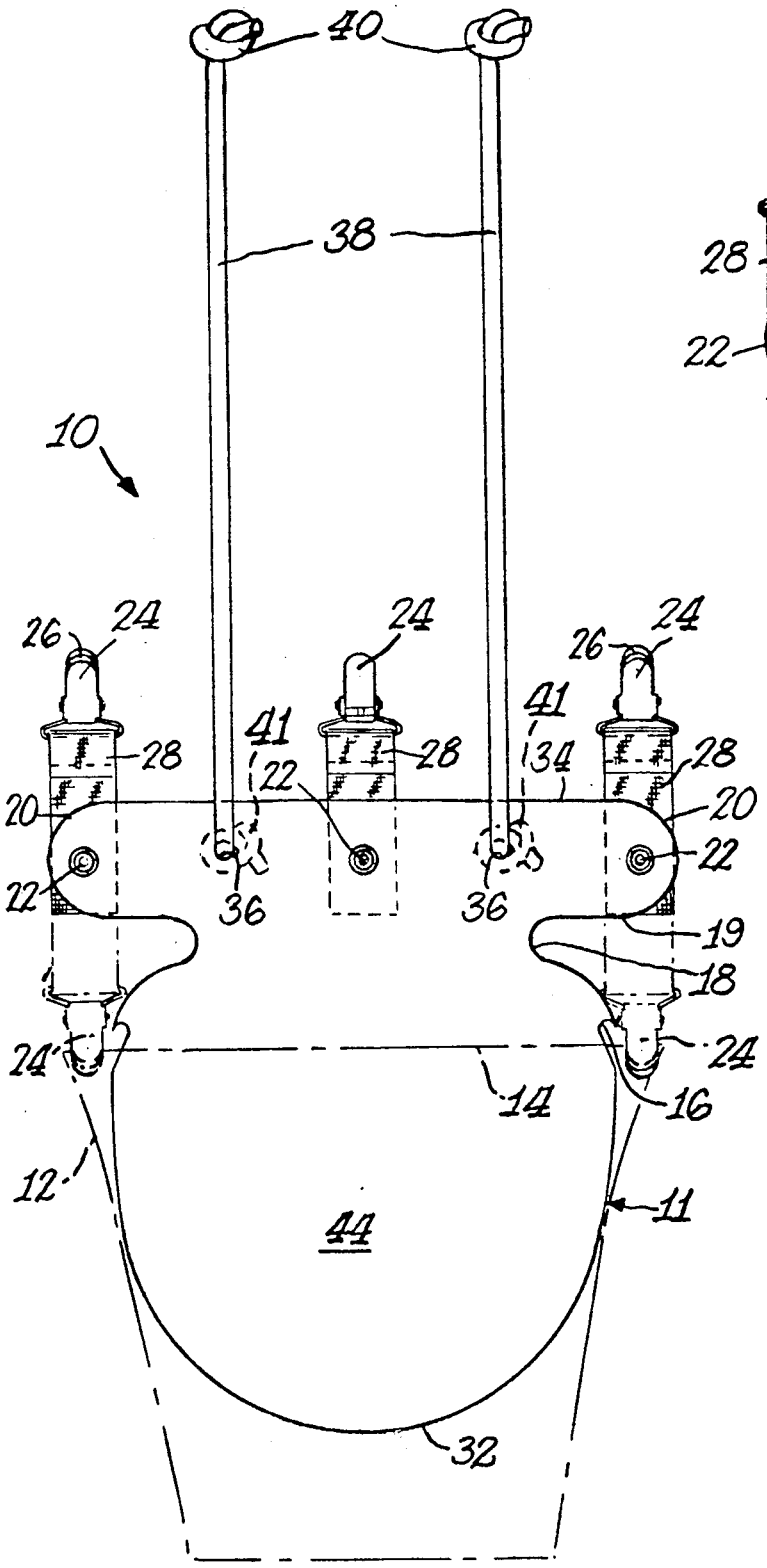
FIG. 1 is a front elevational view of a sock applicating device using the fastener assembly of this invention with a sock shown in phantom outline and with two of the fasteners shown in phantom engaging the top of the sock.

FIG. 1 shows the use of the fastener 24 of this invention with a stocking puller or sock applicating device designated generally as 10. The sock applicating device 10 is the subject of parent application Ser. No. 483,388, the details of which are incorporated herein by reference thereto. Device 10 will be described to the extent necessary to understand the operation of fastener 24. Applicating device 10 includes a flexible shovel shaped sheet 11 having a rounded tip 32 with a pair of ears or lobes 20 formed at the remote end of sheet 11. A pair of registry notches 16 are formed on opposite sides of sheet 11 between the cutouts 18 which create the ears and the rounded tip 32. A plurality, preferably three, fasteners 24 made in accordance with this invention are provided on the remote end of sheet 11. Fasteners 24 are mounted in such a manner that they can be detachably connected to the upper edge 14 of sock 12. For example, fasteners 24 may include a strap 28 having a clip or buckle 26 at the end thereof rotatably mounted by a snap fastener on rivet 22. In addition, device 10 includes a pair of pull cords 38 secured to the remote end of sheet 11.

As illustrated in FIG. 1, the flexible shovel shaped sheet 11 has a sock 12 mounted on it with its top edge 14 positioned in the notches 16. Ears or lobes 20 are shaped in the device by removing the material in the cut outs 18. The edge 19 of the cut out 18 is about two (2) inches from the rear edge 34 of the stocking puller 10. The sock 12 is first pulled over the forward end or rounded tip 32 of the stocking puller 10 as will be shown in more detail in the figures. Each elastic strap 28 is attached at one end to a clip or buckle 26 and attached at the other end to the flexible shovel shaped sheet 11 by means of rivets 22. Rivets 22 permit straps 28 to rotate and permit straps 28 to be detached. The middle fastener 24 is located on the longitudinal centerline of the shovel shaped sheet 11. A hole 36 is located midway between each set of rivets 22 and through these holes 36 is passed a pulling rope or cord 38 which is held in place with knots 40 and 41 on the ends of the rope 38 or in any suitable manner. While FIG. 1 shows two ropes 38 a single continuous rope with two knots on its ends after being pushed through the hole 36 can also be used as shown in FIG. 11. The stocking puller or applicating device 10 has two sides, a bottom side 42 which faces downward when in use and a top side 44.

Figure 3:
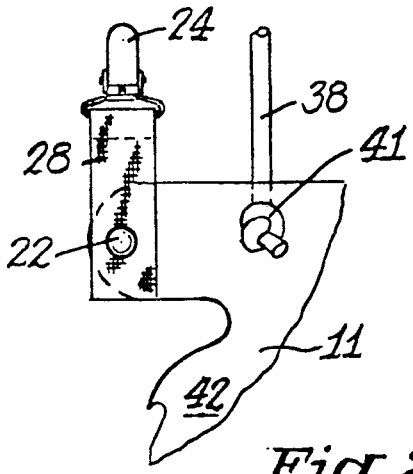
FIG. 3 is a fragmented rear elevational view of the fastener assembly and the knotted end of the pulling cord of the device of FIGS. 1-2.
Figure 2:
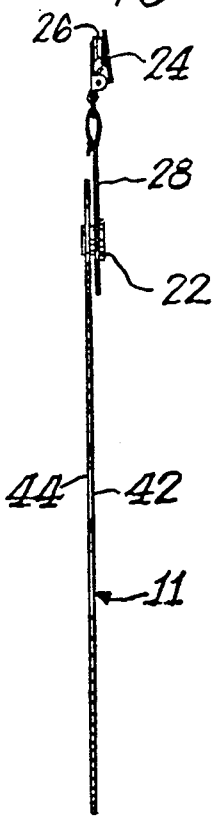
FIG. 2 is a side elevational view of the device of FIG. 1.

FIG. 3 shows some of the details of the bottom side 42 of the sheet 11 with the knot 41 and the rivet 22 shown holding an outside grasping clamp or fastener 24 and its elastic strap 28 onto the car 20 of the flexible sheet 11.

In a preferred practice of this invention, straps 28 are elastic or stretchable. The invention, however, may be practiced with the straps being non-elastic since the fasteners 24 can still be properly positioned by being spaced from the pivot points provided by rivets 22 a length sufficient to position the clamps 26 of fasteners 24 at the top 14 of sock 12.

The sock puller 10 effectively overcomes the problems encountered with prior devices. For example, certain prior art has the problem of not coping with the resistance of the heel and the foot of the sock. This is solved with the device 10 by using a "pants suspender" toggle-type clasp or buckle 26 with a woven elastic strap 28 approximately 1⅛ by 3 inches fastened to the backside on the centerline near the top of sheet 11 with a heavy-duty snap fastener. In operation, when the buckle 26 is clipped on the back top edge 14 of sock 12, a pull on the cords 38 will pull the sock 12 over the heel of the foot.

Figure 4:
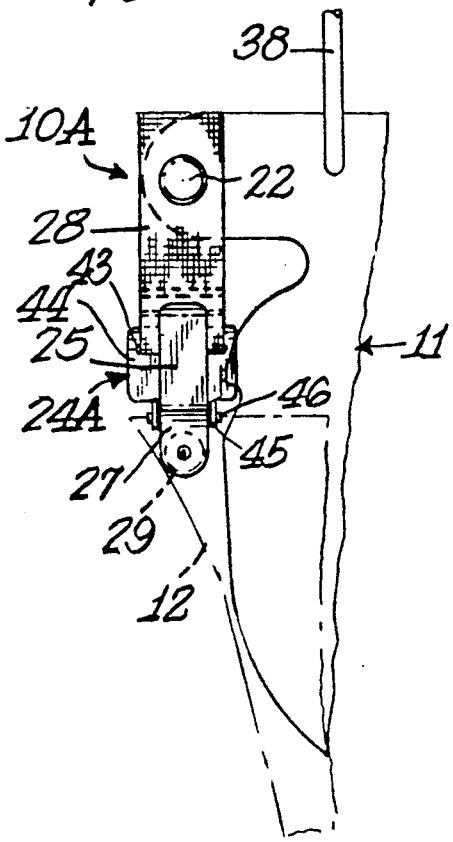
FIG. 4 is a fragmented front elevational view showing a fastener in accordance with this invention.
Figure 5:
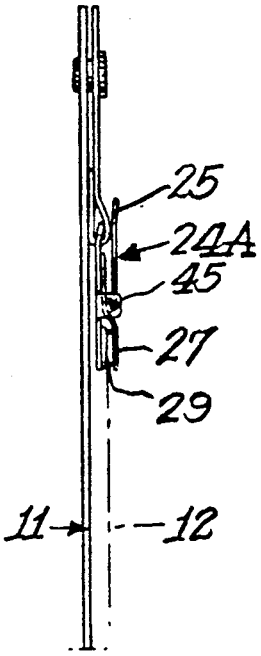
FIG. 5 is a side elevational view of the fastener shown in FIG. 6.
Figure 6:
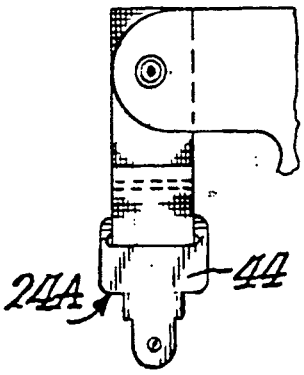
FIG. 6 is a rear elevational view of the fastener shown in FIGS. 4-5.
Figure 7:
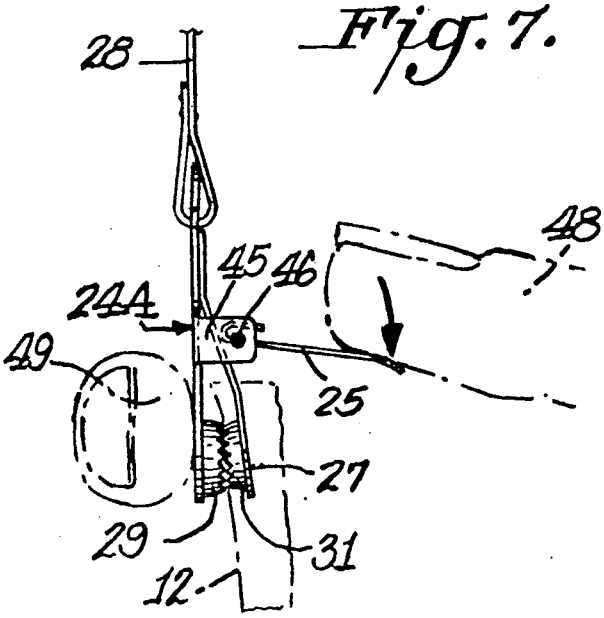
FIG. 7 is a side elevational view of the fastener shown in FIGS. 4-6 during one step of its operation.

FIGS. 4–7 illustrate a fastener 24A in accordance with invention which is particularly designed for one-handed operation. As shown therein, fastener 24A on device 10A includes elastic strap 28 pivotally mounted on snap fastener rivet 22. Strap 28 is secured through a slot 43 in plate 44. As best shown in FIGS. 6–7, plate 44 is generally T-shaped and includes a pair of flanges 45 which are bent upwardly 90 degrees to provide a set of parallel walls. As shown in FIGS. 4 and 7, extensions 46 from actuating lever 25 are mounted in aligned holes in walls 45. The grasping or clamping mechanism includes a toothed clamp member 29 disposed for contact by a second toothed clamp member 31 on spring arm 27 as most clearly shown in FIG. 7. The provision of sidewards extensions or projections 46 of lever 25 provides a fulcrum for the forefinger 49 so that the thumb 48 will have something to push against to open and close the clamp members 29, 31 of the fastener. As shown, for example, in FIG. 7, actuating lever or handle 25 terminates in a curled or bent end to facilitate the operation of the handle and increase its capacity. The bent or curled end facilitates actuation of lever 25 when lever 25 rests on strap 28 as shown in FIG. 5. Lever 25 is of extended length such as 1⅜ inches long. This extended length increases the power of the handle and the ease of operating the grasping means. In effect the handle is reversed from the conventional structure thereby making it easier to operate by achieving and maintaining the full power of the 90 degree angle of the bit to the jaw progressively and reaching the maximum pressure or bite at the closed portion of the buckle. The fulcrum end of lever 25 selectively presses against or releases spring arm 27 to open or close the fastener. This construction also allows the handle to be operated easily by the thumb 48 of one hand while using the forefinger 49 of the same hand as a fulcrum under the lower jaw or plate 44 to push against. The upper spring arm 27 is also lengthened and has a 20 degree offset bend in it to allow for the opening of the jaws. The spring arm 27 may be riveted to the lower jaw 44 or as illustrated may be spot welded. The fastener shown in FIGS. 4–7 best represents a modification of, for example, a commercial-type suspender buckle having plastic teeth. This modification includes, for example, extending the length and width of the various components and reversing the direction of operation of the handle or lever. Jaws 29, 31 are closed when lever 25 is pivoted against strap 28 and are opened when lever 25 is pivoted against spring 27.

The above description relates to the use of the invention with a sock applicating device. It is to be understood, however, that the invention may have other uses where it is desired to provide a fastener which can be easily and conveniently manipulated including manipulation with a single hand. Such fasteners may be used, for example, with suspenders or for securement to other articles of clothing. Other uses include mens and womens accessories, medical devices, military uses, etc. FIG. 8 illustrates the incorporation of fasteners 24 at the ends of the straps 80 which are secured together to form a set of suspenders S. Such suspenders except for the provision of fasteners 24 would be of conventional construction and would include, for example, an adjusting clip 82 on opposite straps 80.

FIG. 9 shows a variation of this invention wherein fastener 24B is secured to strap 28B in a slightly different manner than previously described. In this embodiment strap 28B is inserted through the slot in plate 44 as previously described. The end 84 of strap 28B is then folded over so that the extreme end portion 86 is located between portion 84 and upstream portion 88 to provide a three-ply layer. This doubling of the end which provides a three-ply layer gives the strap a level stance to the pressor foot of a sewing machine when the strap is sewn to the buckle or plate portion 44. This feature facilitates the manufacture of fastener 24B. Fastener 24B provides easy access of the thumb 48 to the lever 25 of fastener 24B and also gives a fulcrum to the forefinger.

The fastener of this invention thus provides a structure which can be conveniently manipulated including manipulation with a single hand. Additionally, the fastener lends itself to ease of manufacture and to wide spread use for being fastened to any type of object and particularly to textile articles of clothing.

What is claimed is:

1. A fastener for securement to textile clothing comprising a buckle including a plate having a near end and a remote end, a strap connected to said near end of said plate, a lower clamping jaw fixed on said plate remote from said strap, a spring arm mounted to said plate, said spring arm having an upper clamping jaw movable toward and away from said lower clamping jaw, an actuating lever mounted to said plate remote from said clamping jaws, said lever having a free end disposed above said clamping jaws and extending beyond said spring arm, and said lever being pivotally mounted to said plate whereby movement of said free end of said lever toward and away from said spring arm causes said clamping jaws to selectively move toward and away from each other.

2. The fastener of claim 1 wherein said plate includes a pair of flanges bent away from said plate to form a pair of walls, aligned holes in said wall, said actuating lever having a pair of projections disposed in said aligned holes to comprise the pivotal mounting of said lever to said plate, and said free end of said lever being bent toward said clamping jaws.

3. The fastener of claim 2 wherein said clamping jaws are closed when said free end of said lever is pivoted away from said spring arm and said clamping jaws are opened when said free end of said lever is pivoted toward said spring arm whereby said lever may be manipulated to open and close said clamping jaws with a single hand of the user.

4. The fastener of claim 3 wherein said strap is made of an elastic material.

5. The fastener of claim 4 wherein said near end of said plate includes a slot, one end of said strap being inserted through said slot, said one end of strap being folded upon itself to form a triple layer beyond said plate with the central layer in line with said plate and said layers of said triple layer being secured together to connect said strap to said plate.

6. The fastener of claim 5 wherein said free end of said lever terminates in an upwardly bent portion.

7. The fastener of claim 1 wherein said clamping jaws are closed when said free end of said lever is pivoted away from said spring arm and said clamping jaws are opened when said free end of said lever is pivoted toward said spring arm whereby said lever may be manipulated to open and close said clamping jaws with a single hand of the user.

8. The fastener of claim 1 wherein said strap is made of an elastic material.

9. The fastener of claim 1 wherein said near end of said plate includes a slot, one end of said strap being inserted through said slot, said one end of strap being folded upon itself to form a triple layer beyond said plate with the central layer in line with said plate and said layers of said triple layer being secured together to connect said strap to said plate.

10. The fastener of claim 1 wherein said free end of said lever terminates in an upwardly bent portion.

11. The fastener of claim 1, in combination therewith, a sock applicating device, and said strap being mounted to said sock applicating device.

12. The combination of claim 11 wherein said sock applicating device includes a shovel-shaped sheet having a rounded tip at its lead end and a remote end, a pair of lobes formed in said remote end, one of said fasteners being mounted to each of said lobes and a further one of said fasteners being mounted to said remote end midway between said lobes.

13. The combination of claim 12 wherein each of said fasteners is detachably mounted to said remote end by a pivot member.

14. The fastener of claim 1, in combination therewith, a pair of suspenders having a plurality of free ends, and one of said fasteners being mounted to a respective free end by said free end comprising said strap of said fastener.

15. The combination of claim 14 wherein said suspenders has four free ends.

* * * * *